US005611586A

United States Patent [19]

Kang

[11] Patent Number: 5,611,586

[45] Date of Patent: Mar. 18, 1997

[54] DEVICE FOR HELPING A DISABLED PERSON USE CHOPSTICKS

[76] Inventor: Sue-May Kang, 7F., No. 276, Ming-Te Rd., Taipei, Taiwan

[21] Appl. No.: 574,149

[22] Filed: Dec. 18, 1995

[51] Int. Cl.[6] ..... A47G 21/10; A47J 43/28

[52] U.S. Cl. ..... 294/99.2; 294/1.1

[58] Field of Search ..... 294/1.1, 8.5, 11, 294/25, 33, 99.2, 86.42; 30/142, 147–150; D7/642, 686

[56] References Cited

U.S. PATENT DOCUMENTS

| | | | |
|---|---|---|---|
| D. 343,096 | 1/1994 | Lachapelle | 294/99.2 |
| 3,323,825 | 6/1967 | Arima | 294/99.2 |
| 3,501,191 | 3/1970 | Darr | 294/99.2 |
| 3,637,248 | 1/1972 | Arita | 294/99.2 |
| 4,035,865 | 7/1977 | McRae et al. | 294/1.1 |
| 4,261,608 | 4/1981 | Bradshaw | 294/99.2 |
| 4,659,128 | 4/1987 | Dong | 294/99.2 |
| 4,721,334 | 1/1988 | Nakatsu | 294/99.2 |
| 4,821,417 | 4/1989 | Levine | 30/142 |
| 5,486,029 | 1/1996 | Kobayashi | 294/99.2 |

*Primary Examiner*—Dean Kramer
*Attorney, Agent, or Firm*—Bacon & Thomas

[57] ABSTRACT

A device for helping a disabled person use chopsticks, including two sleeves for holding a pair of chopsticks, a connecting element connected between the sleeves, an operating frame having two opposite ends respectively connected to the sleeves, the operating frame being operated with the hand to move the sleeves relative to each other, thereby causing the chopsticks to act against each other for raising food to the mouth.

1 Claim, 6 Drawing Sheets

DEVICE FOR HELPING A DISABLED PERSON USE CHOPSTICKS

BACKGROUND OF THE INVENTION

The present invention relates to a device for helping a disabled person use chopsticks. The device can also help any person use chopsticks with either hand.

Chopsticks are commonly used by Chinese and Japanese people for raising food to the mouth. However, it is not easy to a disabled person or a westerner to use chopsticks. It is also difficult to a left-handed person to use chopsticks with the right hand.

SUMMARY OF THE INVENTION

The present invention has been accomplished under the circumstances in view. It is one object of the present invention to provide a device for helping a person to use chopsticks which can be conveniently operated to move the chopsticks in course, so that the chopsticks can positively raise food to the mouth. It is another object of the present invention to provide a device for helping a person to use chopsticks which is simple and inexpensive to manufacture.

DETAILED DESCRIPTION OF THE PREFERRED EMBODIMENT

Figure 1:
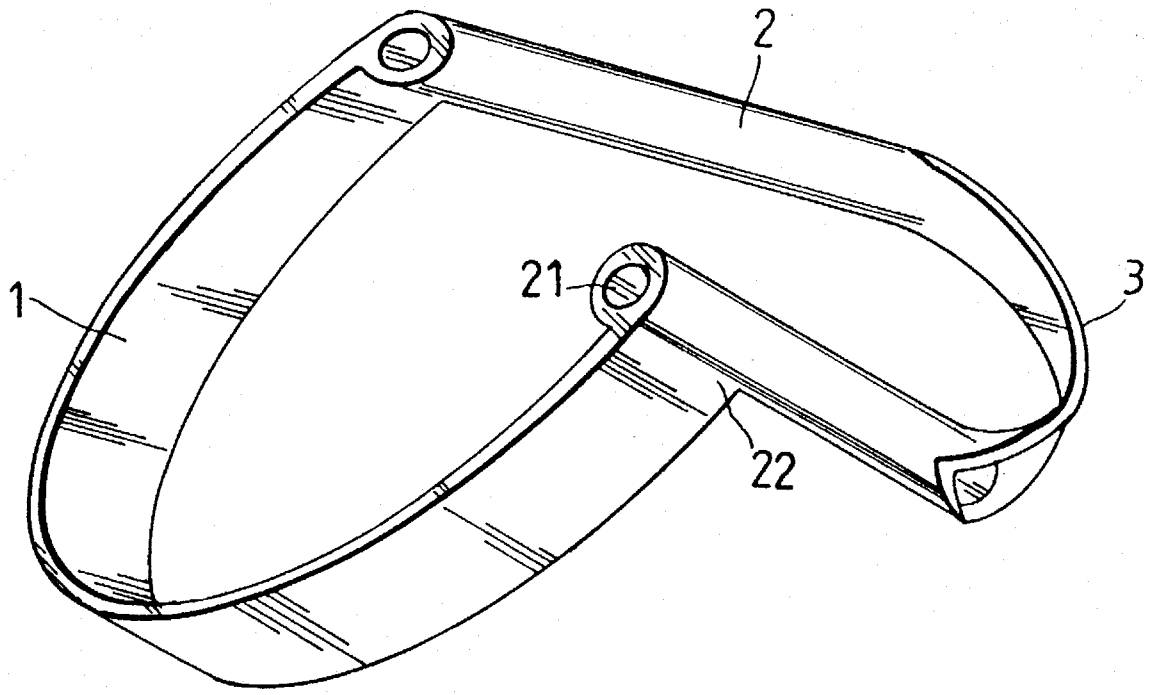
FIG. 1 is an elevational view of the preferred embodiment of the present invention.
Figure 2:
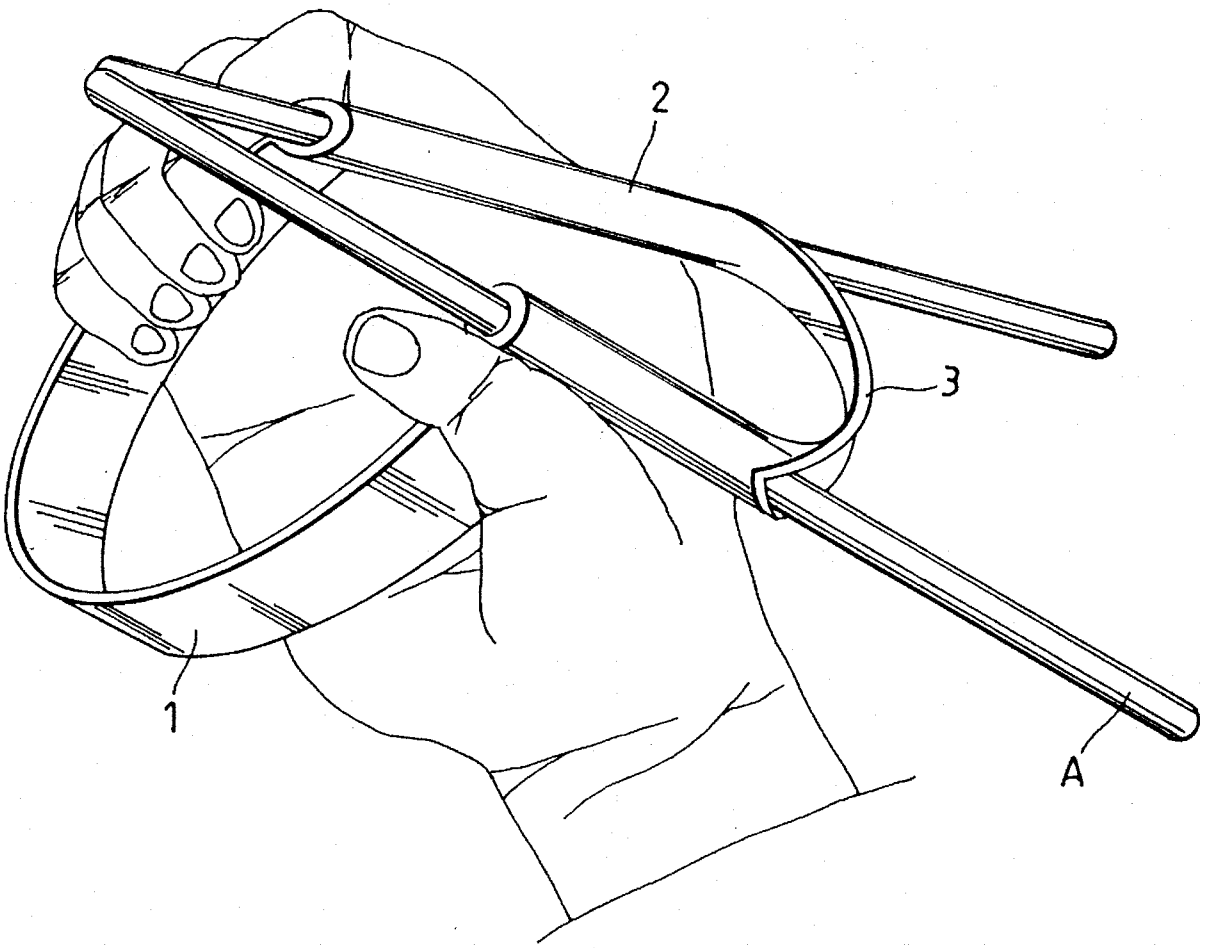
FIG. 2 is an applied view showing the device of the preferred embodiment of the present invention operated.
Figure 4:
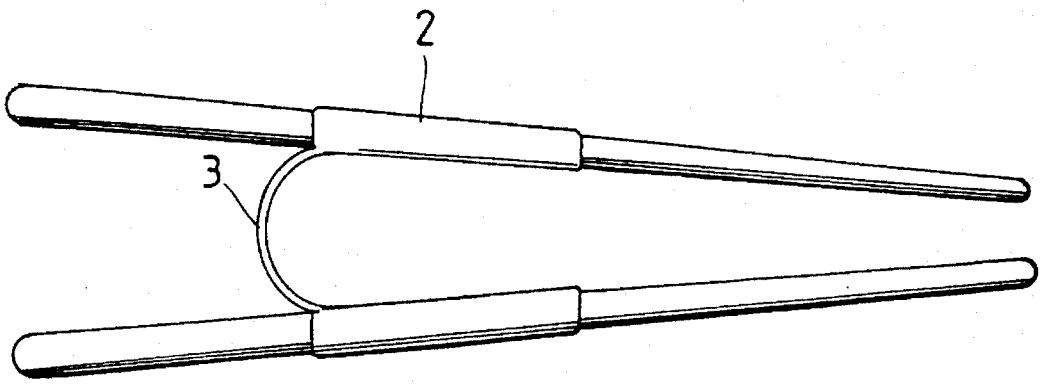
FIG. 4 shows the connection between the connecting element and two sleeves of the present invention.
Figure 5:
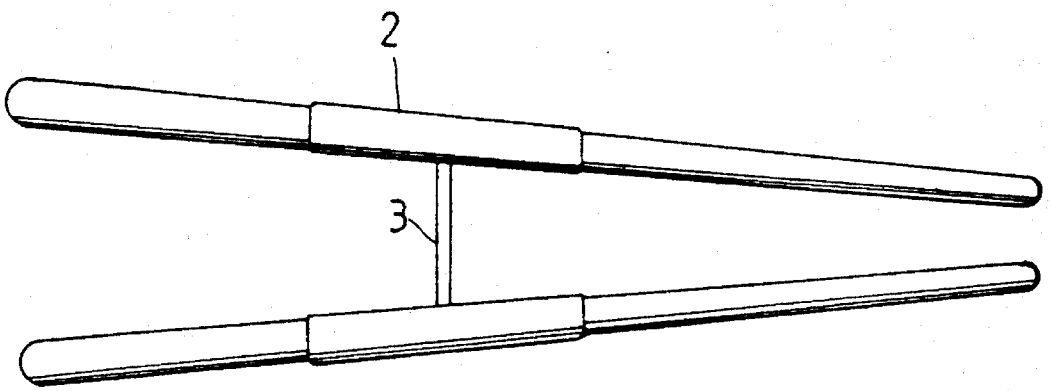
FIG. 5 shows an alternate form of the connection between the connecting element and two sleeves of the present invention.
Figure 6:
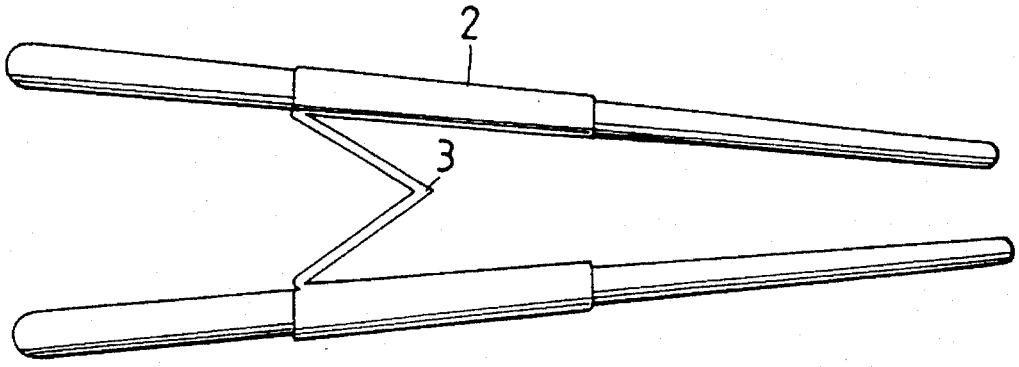
FIG. 6 shows another alternate form of the connection between the connecting element and two sleeves of the present invention.
Figure 7:
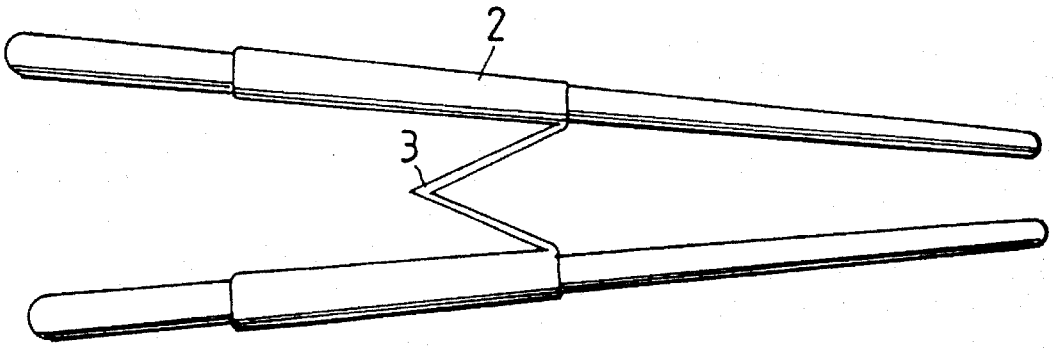
FIG. 7 shows another alternate form of the connection between the connecting element and two sleeves of the present invention.
Figure 8:
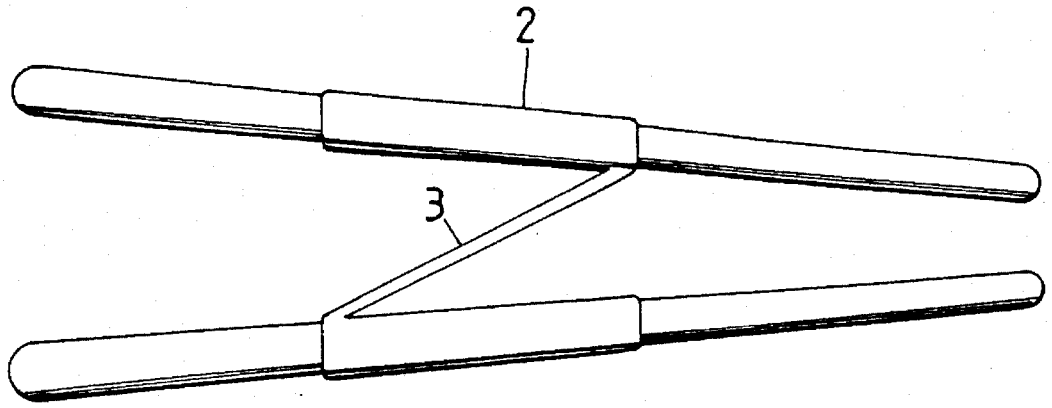
FIG. 8 shows another alternate form of the connection between the connecting element and the sleeves of the present invention.
Figure 9:
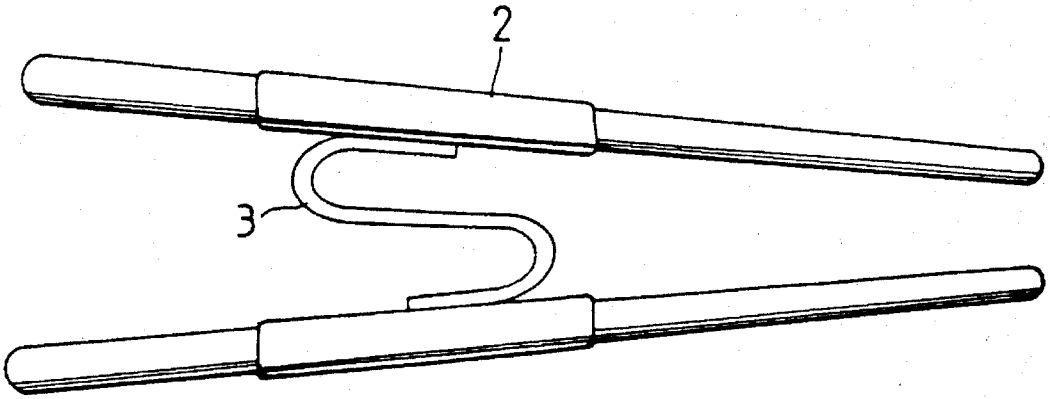
FIG. 9 shows another alternate form of the connection between the connecting element and the sleeves of the present invention.

Referring to FIGS. 1 and 2, a device for helping a disabled person use chopsticks in accordance with the present invention is generally comprised of an operating frame 1, two sleeves 2, and a connecting element 3. The operating frame 1 is made of substantially arched shape having two opposite ends respectively connected to the sleeves 2 at a certain angle. For example, the two opposite ends of the operating frame 1 shown in FIG. 1 are perpendicularly connected to the sleeves 2. Each of the sleeves 2 defines an axial through hole 21 for snugly receiving one stick of the chopsticks A. The connecting element 3 is connected between the sleeves 2. When the sleeves 2 and the connecting element 3 connect together, they can have a variety of configuration, such as: a substantially U-shaped configuration (as shown in FIG. 4), a substantially H-shaped configuration (as shown in FIG. 5), a substantially W-shaped configuration (as shown in FIG. 6,7), a substantially Z-shaped configuration (as shown in FIG. 8), or a substantially S-shaped configuration (as shown in FIG. 9). Furthermore, due to the resilient characteristic of the operating frame 1, when the connection portions 22 are depressed inwards, the chopsticks A are moved relative to each other, and therefore food can be positively raised to the mouth.

Figure 3:
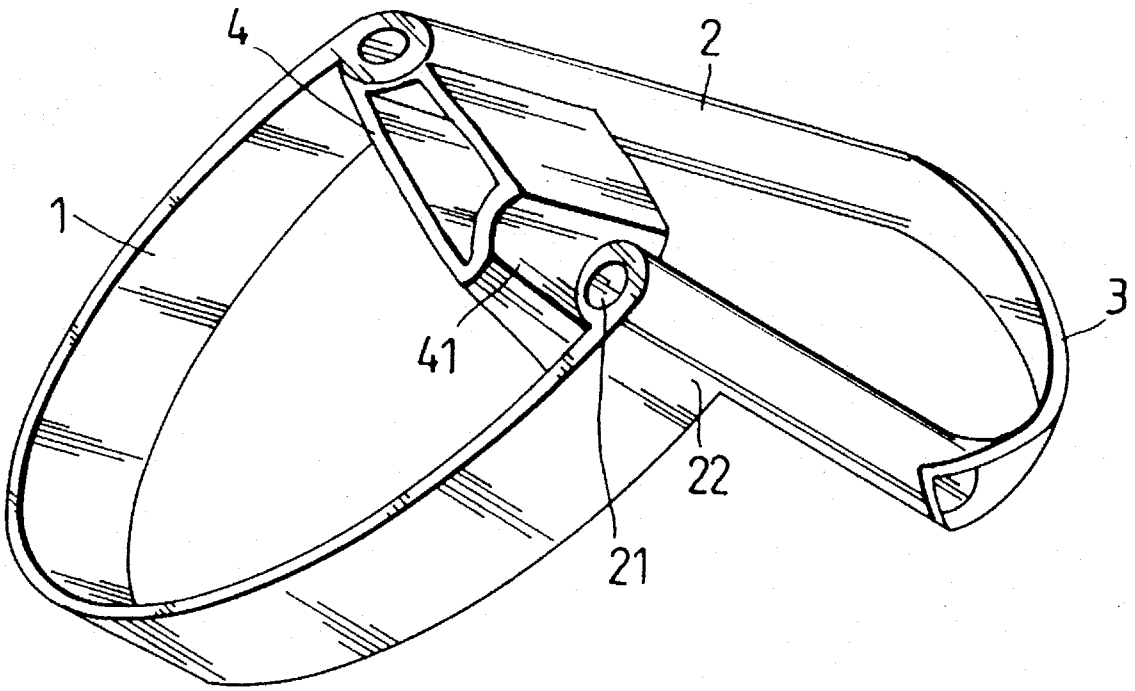
FIG. 3 shows an alternate form of the present invention.

FIG. 3 shows an alternate form of the present invention in which a hollow or solid tapered guide member 4 is connected to one sleeve 2 at an inner side. The tapered guide member 4 stops the two sleeves 2 in such a position that the ends of the chopsticks are attached to each other when the operating frame 1 is squeezed. Therefore, the tapered guide member 4 guides the chopsticks in course to positively raise food to the mouth.

It is to be understood that the drawings are designed for purposes of illustration only, and are not intended as a definition of the limits and scope of the invention disclosed.

I claim:

1. A device for helping a disabled person use chopsticks, comprising:

a) a first sleeve and a second sleeve, each sleeve having a longitudinal hole therethrough for snugly receiving one stick of a pair of chopsticks;

b) a connecting element horizontally connected between said first sleeve and said second sleeve;

c) an operating frame having two opposite ends respectively connected to said first sleeve and said second sleeve, said operating frame being adapted for compression by the hand of a user to move said sleeves relative to each other, thereby causing the chopsticks to act against each other for raising food to the mouth of the user; and d) a tapered guide member having one side secured to said first sleeve and an opposite curved side for engagement by said second sleeve to maintain said second sleeve in position when said operating frame is compressed.

* * * * *